US008747644B2

(12) United States Patent
Dudley et al.

(10) Patent No.: US 8,747,644 B2
(45) Date of Patent: Jun. 10, 2014

(54) APPARATUS AND METHOD FOR REDUCTION OF A SOLID FEEDSTOCK

(75) Inventors: Peter G. Dudley, Hickleton (GB); Allen Richard Wright, Gunnerton (GB)

(73) Assignee: Metalysis Limited, Rotherham (GB)

( * ) Notice: Subject to any disclaimer, the term of this patent is extended or adjusted under 35 U.S.C. 154(b) by 167 days.

(21) Appl. No.: 13/320,079

(22) PCT Filed: May 12, 2010

(86) PCT No.: PCT/GB2010/000954

§ 371 (c)(1),
(2), (4) Date: Mar. 6, 2012

(87) PCT Pub. No.: WO2010/130995

PCT Pub. Date: Nov. 18, 2010

(65) Prior Publication Data

US 2012/0160699 A1 Jun. 28, 2012

(30) Foreign Application Priority Data

May 12, 2009 (GB) ..... 0908151.4
May 12, 2009 (GB) ..... 0908152.2

(51) Int. Cl.
*C25C 3/00* (2006.01)
*C25C 3/08* (2006.01)
*C25C 7/08* (2006.01)

(52) U.S. Cl.
USPC ..... 205/367; 205/354; 205/383; 204/243.1; 204/268

(58) Field of Classification Search
CPC ..... C25C 5/04; C25C 7/005
USPC ..... 205/264–411; 204/244, 237, 268, 243.1
See application file for complete search history.

(56) References Cited

U.S. PATENT DOCUMENTS 3,755,099 A * 8/1973 Haupin ..... 205/375
4,154,661 A * 5/1979 Hyland et al. ..... 205/383

(Continued)

FOREIGN PATENT DOCUMENTS

EP 0 257 710 3/1988
EP 1 876 248 1/2008

(Continued)

OTHER PUBLICATIONS

Ishikawa, T. et al. "Application of a Vertically Stacked Bipolar Electrode Cell to Electrowinning of Liquid Magnesium from Chloride Melts" *Electrochemistry*, 1997, vol. 65, No. 12, pp. 1080-1085.

(Continued)

*Primary Examiner* — Nicolas A Smith
*Assistant Examiner* — Brian W Cohen
(74) *Attorney, Agent, or Firm* — Saliwanchik, Lloyd & Eisenschenk

(57) ABSTRACT

In a method for reducing a solid feedstock (110), such as a solid metal compound, feedstock is arranged on upper surfaces of elements (60, 80, 81) in a bipolar cell stack contained within a housing (25). A molten salt electrolyte is circulated through the housing so that it contacts the elements of the bipolar stack and the feedstock. A potential is applied to terminal electrodes (50, 60) of the bipolar stack such that the upper surfaces of the elements become cathodic and the lower surfaces of the elements become anodic. The applied potential is sufficient to cause reduction of the feedstock. The invention also provides an apparatus for implementing the method.

18 Claims, 5 Drawing Sheets

(56) References Cited

U.S. PATENT DOCUMENTS

| | | | | |
|---|---|---|---|---|
| 4,308,114 | A * | 12/1981 | Das et al. | 205/380 |
| 4,400,247 | A | 8/1983 | Ginatta | |
| 4,414,089 | A * | 11/1983 | McMonigle et al. | 204/244 |
| 5,089,094 | A | 2/1992 | Ogasawara et al. | |
| 5,935,394 | A | 8/1999 | Sivilotti et al. | |
| 2004/0159559 | A1 * | 8/2004 | Fray et al. | 205/705 |
| 2006/0049060 | A1 | 3/2006 | Hori | |

FOREIGN PATENT DOCUMENTS

| | | |
|---|---|---|
| EP | 1 942 210 | 7/2008 |
| GB | 1 568 499 | 5/1980 |
| IT | 1188878 | 1/1988 |
| JP | 3236486 | 10/1991 |
| JP | 5263285 | 10/1993 |
| JP | 2009197277 | 9/2009 |
| WO | WO 99/64638 | 12/1999 |
| WO | WO 00/03068 | 1/2000 |
| WO | WO 03/002785 | 1/2003 |
| WO | WO 2004113593 A1 * | 12/2004 |
| WO | WO 2005/031041 | 4/2005 |
| WO | WO 2008/101283 | 8/2008 |

OTHER PUBLICATIONS

Kusakabe, K. et al. "Current Paths and Electrolysis Efficiency in Bipolar Packed-Bed Electrodes" *Journal of Chemical Engineering of Japan*, 1982, vol. 15, No. 1, pp. 45-50.

* cited by examiner

APPARATUS AND METHOD FOR REDUCTION OF A SOLID FEEDSTOCK

CROSS-REFERENCE TO RELATED APPLICATION

This application is the National Stage of International Application Number PCT/GB2010/000954, filed May 12, 2010, which is hereby incorporated by reference herein in its entirety, including any figures, tables, nucleic acid sequences, amino acid sequences, or drawings.

The invention relates to an apparatus and method for the reduction of a solid feedstock, in particular for the production of metal by electrolytic reduction of a solid feedstock.

BACKGROUND

The present invention concerns the reduction of solid feedstock comprising metal compounds, such as metal oxides, to form products. As is known from the prior art, such processes may be used for example to reduce metal compounds or semi-metal compounds to metals, semi-metals or partially-reduced compounds, or to reduce mixtures of metal compounds to form alloys. In order to avoid repetition, the term metal will be used in this document to encompass all such products, such as metals, semi-metals, alloys, intermetallic and partially-reduced products.

In recent years there has been great interest in the direct production of metal by reduction of a solid feedstock, for example, a solid metal-oxide feedstock. One such reduction process is the Cambridge FFC electro-decomposition process (as described in WO 99/64638). In the FFC method a solid compound, for example a solid metal oxide, is arranged in contact with a cathode in an electrolytic cell comprising a fused salt. A potential is applied between the cathode and an anode of the cell such that the solid compound is reduced. In the FFC process the potential that reduces the solid compound is lower than a deposition potential for a cation from the fused salt. For example, if the fused salt is calcium chloride then the cathode potential at which the solid compound is reduced is lower than a deposition potential for depositing calcium from the salt.

Other reduction processes for reducing feedstock in the form of cathodically-connected solid metal compounds have been proposed, such as the Polar process described in WO 03/076690 and the process described in WO 03/048399.

Conventional implementations of the FFC and other electrolytic reduction processes typically involve the production of a feedstock in the form of a preform or precursor fabricated from a powder of the solid compound to be reduced. This preform is then painstakingly coupled to a cathode to enable the reduction to take place. Once a number of preforms have been coupled to the cathode, then the cathode can be lowered into the molten salt and the preforms can be reduced. It can be very labour intensive to produce the preforms and then attach them to the cathode. Although this methodology works well on a laboratory scale, it does not lend itself to the mass production of metal on an industrial scale.

It is an aim of the invention to provide a more suitable apparatus and method for the reduction of a solid feedstock on industrial scales.

SUMMARY OF INVENTION

The invention provides a method and apparatus as defined by the appended independent claims, to which reference should now be made. Preferred or advantageous features of the invention are defined in dependent sub-claims.

In its various aspects, the invention relates to the reduction of a solid feedstock that is arranged on, or in contact with, a bipolar element or electrode, and in particular to methods and apparatus for performing such a reduction.

Thus, a first aspect of the invention may provide a method for reducing a solid feedstock comprising the steps of arranging a portion of feedstock on an upper surface of a bipolar element within a bipolar cell stack, the bipolar cell stack being disposed within a housing, circulating molten salt through the housing such that the molten salt contacts both the element and the feedstock, and applying a potential across terminal electrodes of the bipolar cell stack such that upper surfaces of the bipolar elements become cathodic and lower surfaces of the bipolar elements become anodic, the applied potential being sufficient to cause reduction of the solid feedstock.

The term arranging includes any method by which the solid feedstock is brought into contact with and retained against a surface of the bipolar element. The term includes the loading of individual constituent units of a solid feedstock one by one, and the simultaneous loading of a large number of constituent units of solid feedstock, for example by pouring them onto the bipolar element.

A bipolar element, which may also be termed a bipolar electrode, is an element that is interposed between a terminal anode and a terminal cathode such that it develops an anodic surface and a cathodic surface when a potential is applied between the terminal anode and the terminal cathode. The anode and the cathode of a bipolar stack may be termed the terminal electrodes of the stack.

A bipolar cell stack comprises at least one bipolar element. Preferably, the bipolar cell stack used in the method comprises a plurality of bipolar elements and the method comprises the step of loading feedstock onto a feedstock-bearing portion or a feedstock-bearing surface, which may advantageously be an upper surface, of each of the plurality of elements. A greater number of elements advantageously increases the volume of feedstock that may be loaded into a cell and therefore may increase the volume of material reduced during a single reduction, or operating cycle of the cell.

It is preferable that the reduction occurs by an electrolytic reduction such as electro-decomposition. For example, the reduction may be carried out by the FFC Cambridge process of electro-decomposition as described in WO 99/64638, or by the Polar process described in WO 03076690 or the Reactive Metal variant described in WO 03/048399.

The feedstock is preferably made up from a plurality of constituent units. It is preferred that the individual constituent units of the feedstock are in the form of granules or particles, or in the form of preforms made by a powder processing method. Known powder processing methods suitable for making such a preform include, but are not limited to, pressing, slip-casting, and extrusion.

Preforms made by powder processing may be in the form of prills. Powder processing methods may include any of the known conventional manufacturing techniques such as extrusion, spray drying or pin mixers etc. Once formed the constituent units of feedstock may be sintered to improve/increase their mechanical strength sufficiently to enable the necessary mechanical handling.

It may be advantageous if the feedstock is able to be loosely poured onto the surfaces of the bipolar elements. At present, many electro-reduction methods for reducing a solid feedstock involve the step of coupling individual units or parts of the solid feedstock to the cathode. Advantageously, the invention may allow a large amount of feedstock to be introduced or arranged on the upper surfaces of the bipolar elements simply by pouring it on.

Feedstock may be distributed onto the upper surface of each bipolar element, for example by pouring the feedstock onto the upper surface of each bipolar element, and the bipolar stack then built up by introducing successively higher bipolar elements into the housing. Alternatively, the entire bipolar stack, or at least a portion of the bipolar stack comprising the bipolar elements, may be removable from the housing as a single unit within a frame, and feedstock may then be applied to each element, for example by pouring the feedstock or arranging the feedstock in any other way. In a preferred embodiment feedstock may be applied to each individual bipolar element by moving the bipolar element to allow access for loading, or by removing the bipolar element from the frame entirely to allow loading. Access may be facilitated, for example, by sliding the element out of the frame, pouring on feedstock, or arranging feedstock in any other way, and sliding the element back into the frame.

The term molten salt (which may alternatively be termed fused salt, molten salt electrolyte, or electrolyte) may refer to systems comprising a single salt or a mixture of salts. Molten salts within the meaning used by this application may also comprise non-salt components such as oxides. Preferred molten salts include metal halide salts or mixtures of metal halide salts. A particularly preferred salt may comprise calcium chloride. Preferably the salt may comprise a metal halide and a metal oxide, such as calcium chloride with dissolved calcium oxide. When using more than one salt it may be advantageous to use the eutectic or near eutectic composition of the relevant mixture, for example to lower the melting point of the salt used.

Preferably the method involves steps of stopping the circulation of the molten salt after reduction of the feedstock, draining the molten salt from the housing, and recovering the reduced product.

In a particularly preferable method, the housing is coupled to an inert gas source and the inert gas is passed through the housing in order to rapidly cool the housing and its contents. It may be advantageous to rapidly cool the apparatus to a temperature of below 700° C., or below 600° C. using an inert gas purge or quench before allowing air into the housing. The step of rapid cooling may cause a layer of salt to freeze around the reduced product an act as a protective layer to help prevent oxidation when the product is exposed to air. The combination of rapid cooling and formation of a protective salt layer may speed up the time in which the reduced product can be exposed to air and thus the time in which the product can be recovered may be lowered. Suitable inert gasses for cooling the housing may include argon and helium.

Alternatively, the entire bipolar stack, or at least a portion of the bipolar stack comprising the bipolar elements, may be removed from the cell before the product is recovered. This method may provide the advantage that molten salt need not be drained from the cell and the stack may be swiftly replaced by a new stack loaded with fresh feedstock for a new reduction reaction.

The method may be advantageously used to produce a metal from a metal oxide. For example, if titanium dioxide is used as the solid feedstock, then titanium metal may be produced as a product. There may be situations, however, where the product that is desired is a partially reduced feedstock, i.e. a feedstock that has not been fully reduced to metal.

A second aspect of the invention may provide an apparatus for the reduction of a solid feedstock, for example for the production of metal by reduction of the solid feedstock, comprising a housing having a molten salt inlet and a molten salt outlet, and a bipolar cell stack located within the housing. The bipolar cell stack comprises a terminal anode positioned in an upper portion of the housing, a terminal cathode positioned in a lower portion of the housing, and one or more bipolar elements vertically spaced from each other between the anode and the cathode. An upper surface of each bipolar element, and an upper surface of the terminal cathode, are capable of supporting a portion of the solid feedstock. The apparatus is arranged such that molten salt can enter the housing through the inlet and flow over or through the bipolar cell stack, exiting the housing through the outlet.

The upper surface of the terminal cathode may be a fixed structure that is capable of supporting a solid feedstock. Alternatively, the upper surface of the terminal cathode may be formed from the lowest element in the bipolar stack, being brought into electrical connection with a terminal cathode. In this latter example, the element that is brought into contact with the terminal cathode becomes the acting terminal cathode of the bipolar stack.

The housing effectively contains an electrolytic cell through which molten salt can flow with the terminal electrodes, i.e. the terminal anode and the terminal cathode, and the bipolar elements forming electrodes of the electrolytic cell. The terminal electrodes can be connected to an electricity supply through the housing by a fixed connection or by connections that are readily couplable to an electricity supply.

It is preferable that the housing has a high aspect ratio, i.e. has greater height than width. This advantageously allows a large number of bipolar elements to be positioned in a vertically-spaced arrangement from each other within the housing. Preferably, therefore, the housing is substantially cylindrical or columnar prismatic, for example, a cylinder or column having a substantially circular, ovoid, rectangular, square or hexagonal base. The base of the cylinder or column may be any polygon. The housing may also advantageously take the form of an inverted cone or pyramid, whereby the top of the housing has a larger cross-sectional area than the base. This may allow evolved gasses to escape more easily.

It is preferable that the inlet is defined through a wall of a lower portion of the housing, and the outlet is defined through a wall of an upper portion of the housing. (For the avoidance of doubt, the term wall is used here to refer to the bottom, top, and all of the sides of the housing). This arrangement allows molten salt that is passing through the housing to flow vertically upwards when in use.

It is possible, and may be desirable, for there to be more than one inlet and/or more than one outlet. For example, there may be a molten salt inlet manifold comprising two, three, or four inlet passages defined through the wall of the housing, and likewise there may be two, three, or four outlet passages defined in an outlet manifold.

It is preferable that the inlet and the outlet are couplable to a source of molten salt, such that a circuit of molten salt can be set up, flowing through the cell housing while the apparatus is in use.

Although it is preferable that molten salt passes into the housing at a lower point of the housing and exits the housing at an upper point of the housing while the apparatus is in use, the reverse is possible. Downward flow, i.e. flow arising where the inlet is defined through an upper portion of the housing and the outlet is defined through a lower portion of the housing, may advantageously allow the construction of gravity-fed salt flow systems. The flow of molten salt may also be reversed during processing, or the inlets may be used to drain molten salt from the housing after processing has been completed.

In order for the cell to function properly, the internal wall of the housing, at least in the region adjacent to the bipolar elements of the bipolar cell stack, must be electrically insulating. This may be achieved by having the entire internal surface of the housing, or the portion of the internal surface in the region of the bipolar cell stack, made from an electrically insulating material such as a ceramic.

The bipolar elements may be supported by insulating supporting means extending from the housing wall. For example, lugs of a suitable insulating support may extend from the wall and support the bipolar elements which can then be stacked in vertical spacing from each other. The bipolar elements may also be supported by a framework or supporting structure that hangs from a portion of the housing, for example from the housing wall or from a lid of the housing.

Alternatively, the bipolar elements may be supported by separating members arranged between adjacent elements. In this case, each bipolar element may be supported above a lower element by means of insulating separating members, for example in the form of columns.

Preferably each insulating supporting member is formed from a material that is substantially inert under the desired cell operating conditions. Such materials may include, for example, boron nitride, calcium oxide, yttria, scandia and magnesia. The selection of material will depend to some degree on the stability of the compound being reduced. The supporting members are preferably made from a material that is more stable than the feedstock, under the specific reduction conditions for reducing the feedstock.

Each of the bipolar elements has an x-dimension and a y-dimension that are substantially greater than its z-dimension. In other words, the length and breadth of each element is much greater than its depth. Within the housing the bipolar elements are preferably arranged to be oriented with their length and breadth being substantially horizontal or slightly inclined from the horizontal. The elements are also vertically spaced from each other.

The bipolar elements may be substantially plate-like in structure, i.e. they may be formed from a solid plate of material or solid plates of more than one different material. Preferably, the upper surface of each element is shaped to retain feedstock. As such, the edge or circumference of the upper surface of each element may be bounded by an upwardly-extending flange or rim, or the upper surface of each bipolar element may be in the form of a tray or dish.

Each bipolar element may be made from a single material. For example, each bipolar element may be made from carbon or from a dimensionally stable conducting material that is substantially inert within the cell processing conditions.

In a preferable arrangement, each bipolar element has a composite structure, having a lower, anodic, portion and an upper, cathodic, portion made of different materials. Thus, the lower portion (which forms the anodic surface) may be made of carbon or an inert oxygen-evolving anode material or a dimensionally-stable anode material, and the upper surface (which forms the cathodic surface) may be made of a metal, preferably a metal that does not contaminate or react with the feedstock or the reduced feedstock. Thus, where each bipolar element is a composite, the upper and lower portions may be plates that are coupled together electrically to present a lower anodic surface and an upper cathodic surface.

It may be advantageous, where the bipolar element has a composite structure, for each, or either, of the anodic and cathodic portions themselves to have a composite structure and be formed of one or more layers or sections of one or more different materials. For example, the anodic portion may consist of two separate carbon layers. These layers may function as an upper reusable portion and a lower consumable portion, which can be easily replaced as required at the same time that fresh feedstock is charged to the cell.

Advantageously, the lower portion may be formed as an open or perforated structure, for example in the form of an array of rods or a mesh or a rack. The upper portion may then rest on and be supported by the lower portion. The upper portion may also have an open or perforated structure, which may be particularly advantageous if the lower portion also has an open or perforated structure, thereby facilitating the flow of molten salt through both upper and lower portions.

The upper portion need not be firmly attached to the lower portion. It may be sufficient for the upper portion to merely rest on the lower, anodic portion of the bipolar element in order for the element to function within the cell. Thus, each bipolar element may be formed from an array of rods of carbon, or other suitable anode material, for example an inert oxygen-evolving anode, supported by inert electrically-insulating lugs extending from the wall of the housing or on inert columns supported on a lower electrode in the stack, on which a metallic tray or mesh is supported to act as a cathode.

It may be advantageous that both lower and upper portions of the bipolar elements or, where the bipolar element is a single material, the entire element itself, are in the form of an open or perforated structure through which molten salt can flow. This structure may be a plate that has a plurality of holes that allow the flow of salt, or it may be that the bipolar elements are in the form of a mesh or grid structure. As long as the elements are capable of supporting the solid feedstock and forming an anodic lower surface and a cathodic upper surface, then this structure may advantageously allow salt to flow directly upwards through the housing and may help remove contaminant elements more efficiently.

It is preferable that the apparatus comprises a salt reservoir for supplying molten salt through the inlet of the housing and receiving molten salt passing through the outlet of the housing. The apparatus may also comprise a means for circulating the molten salt through the housing, for example a pump.

The reduction of a solid feedstock in an apparatus comprising a molten salt reservoir is described in the applicant's co-filed PCT patent application, which claims priority from GB 0908151.4, both of which applications are incorporated herein by reference, in their entirety.

If the apparatus comprises a salt reservoir, the reservoir may further comprise filtration means for purifying and/or cleaning the salt, for example, for filtering solid particulates from the salt. In addition the reservoir may comprise a heating means for maintaining the salt in a molten condition.

It is undesirable to pass molten salt into an unheated housing, at least at an initial stage of operation. It is likely that an unheated housing would cause a portion of the molten salt to freeze and, if this occurred to a great degree, the flow of molten salt may be prevented altogether. Thus, it may be advantageous that the apparatus comprises means for heating an internal portion of the housing. Thus, the apparatus may comprise means for blowing hot gases through the housing to warm the internal portion of the housing prior to the introduction of molten salt. These hot gasses are preferably inert gasses such as argon or helium, or mixtures of argon and helium. The hot gasses may also comprise exhaust gasses from another reduction process, for example, the exhaust gasses evolved during a reduction reaction performed in an adjacent cell.

Where the apparatus is heated by hot gasses it may be advantageous for the housing to comprise a gas inlet or inlets and a gas outlet or outlets, preferably at opposite ends of the housing. The gas inlets may be couplable to a supply of hot gas to allow the gas to be introduced into the chamber.

The apparatus may alternatively comprise heating elements or induction means for warming an internal portion of the housing. A preferable heating system may be an induction system configured such that carbon elements of the bipolar stack act as susceptors for heating the cells.

When in operation, the reduction reaction itself may generate enough heat to maintain the salt within the housing in a molten condition.

The apparatus may further comprise means for cooling an internal portion of the housing. For example, the apparatus may comprise a cooling jacket that can be applied to an external wall of the housing, or that is incorporated in an external wall of the housing, in order to extract heat from the housing. This may speed up the processing of the feedstock by allowing the housing to be cooled more rapidly at the end of a reduction run, or it may allow a portion of salt adjacent to the internal wall of the housing to remain solid while the reduction process is in operation as described above.

The apparatus may comprise a gas cooling system for cooling the contents of the housing after reduction has been completed and after salt has been drained. Thus, the housing may comprise an inlet or inlets and an outlet or outlets suitable for supplying a flow of inert gas for cooling the internal portion of the housing down to a predetermined temperature.

It is preferable that the solid feedstock is a metal oxide, which may be a mixed oxide or a mixture of metal oxides. The feedstock may, however, be another solid compound or a mixture of metal and metal oxide or metal compound.

Preferably the housing comprises a bipolar cell stack having between two and twenty-five bipolar elements, for example between three and twenty bipolar elements vertically spaced from each other, particularly preferably between five and fifteen, or between six and ten bipolar elements vertically spaced from each other.

It is preferred that the spacing between bipolar elements is greater than or equal to 2 cm, for example between 4 cm and 20 cm, for example between 5 cm and 15 cm, or between 6 cm and 10 cm.

The bipolar elements preferably have length and breadth or diameter of the order of between 10 cm and 600 cm or more preferably between 50 cm and 500 cm, for example being about 12 cm or 75 cm or 100 cm or 150 cm.

The thickness of each bipolar element preferably varies between 2 cm and 10 cm, for example 3 cm, 4 cm, 5 cm, or 6 cm.

It may be particularly advantageous for the apparatus to comprise more than one separate housing, each housing containing its own stack of bipolar elements. Thus, a number of different individual cells may simultaneously reduce quantities of solid feedstock supplied by the same molten salt source.

Advantageously, the apparatus may additionally comprise a reference electrode. Such an electrode may facilitate control of the apparatus during reduction of feedstock, for example, the voltage between the anode and cathode may be controlled with respect to a reference electrode.

A third aspect of the invention may provide an apparatus, and a method for using the apparatus, for the reduction of a solid feedstock comprising a housing for containing a molten salt, a bipolar cell stack located within the housing, the stack comprising a terminal anode positioned in a first portion of the housing, a terminal cathode positioned in a second portion of the housing, and one or more bipolar elements spaced from each other between the terminal anode and the terminal cathode, in which a first surface of each of the bipolar elements is capable of supporting the feedstock, i.e. feedstock may be retained in contact with the first surface.

A fourth aspect of the invention may provide an apparatus, and a method for using the apparatus, for the reduction of a solid feedstock comprising a housing for containing a molten salt, a bipolar cell stack comprising a plurality of bipolar elements locatable within the housing, a first surface of each of the bipolar elements being capable of supporting the solid feedstock, i.e. feedstock may be retained in contact with the first surface, in which the bipolar cell stack is adapted to facilitate the loading of feedstock to, and/or the unloading of reduced feedstock from, the surfaces of the bipolar elements.

Preferably, the bipolar stack is removably locatable in the housing to enable user access for loading feedstock and unloading reduced feedstock. Individual bipolar elements may be movable into and out of the stack in order to arrange feedstock on the first surface. The movement of individual bipolar elements may advantageously be a sliding movement, and preferable the bipolar elements are horizontally-slidable.

Individual bipolar elements may be entirely or partially removable from the stack in order to facilitate loading and unloading. It may be advantageous, for example, for the first portion of a bipolar element defining the first surface to be separable from a second portion of the element, such that only the first portion of the bipolar element may need to be removable from the stack.

A fifth aspect of the invention may provide an apparatus, and a method of using the apparatus, for the reduction of a solid feedstock comprising a housing for containing a molten salt, a bipolar cell stack comprising a plurality of bipolar elements locatable within the housing, a first surface of each of the bipolar elements being capable of supporting the solid feedstock, in which one or more of the bipolar elements comprise a first or cathode portion, defining the first surface, and a second or anode portion that is electrically couplable to the first portion, the first and second portions being separable from each other.

A sixth aspect may provide an apparatus, and a method for using the apparatus, for the reduction of a solid feedstock comprising a housing for containing a molten salt, a bipolar cell stack comprising a plurality of bipolar elements locatable within the housing, a first surface of each of the bipolar elements being capable of retaining the solid feedstock, in which one or more of the bipolar elements comprise a first or cathode portion, defining the first surface, formed from a first material and a second or anode portion formed from a second material different to the first material.

The apparatus as described in relation to each of the first to sixth aspects of the invention may also comprise a surface of a terminal cathode that is capable of supporting or retaining a portion of feedstock.

It is envisaged that the features described above in relation to the first and second aspects of the invention may also be applied, with changes where appropriate, to any other aspects of the invention described herein, including the third to sixth aspects described above. For example, the apparatuses of these later aspects may comprise molten salt inlets and outlets, and the first surface of the bipolar elements may preferably be an upper surface. The various preferred features associated with the earlier aspects, for example the specific dimensions of elements or specific compositions of materials, are equally applicable to the apparatuses of these later aspects.

The various aspects of the invention as described above lend themselves particularly well to the reduction of large batches of solid feedstock, on a commercial scale. In particular, embodiments comprising a vertical arrangement of the bipolar elements within the apparatus allow a large number of bipolar elements to be arranged within a small plant footprint, effectively increasing the amount of reduced product that can be obtained per unit area of a processing plant.

The methods and apparatus of the various aspects of the invention described above are particularly suitable for the production of metal by the reduction of a solid feedstock comprising a solid metal oxide. Pure metals may be formed by reducing a pure metal oxide and alloys and intermetallics may be formed by reducing feedstocks comprising mixed metal oxides or mixtures of pure metal oxides.

Some reduction processes may only operate when the molten salt or electrolyte used in the process comprises a metallic species (a reactive metal) that forms a more stable oxide than the metallic oxide or compound being reduced. Such information is readily available in the form of thermodynamic data, specifically Gibbs free energy data, and may be conveniently determined from a standard Ellingham diagram or predominance diagram or Gibbs free energy diagram. Thermodynamic data on oxide stability and Ellingham diagrams are available to, and understood by, electrochemists and extractive metallurgists (the skilled person in this case would be well aware of such data and information).

Thus, a preferred electrolyte for a reduction process may comprise a calcium salt. Calcium forms a more stable oxide than most other metals and may therefore act to facilitate reduction of any metal oxide that is less stable than calcium oxide. In other cases, salts containing other reactive metals may be used. For example, a reduction process according to any aspect of the invention described herein may be performed using a salt comprising lithium, sodium, potassium, rubidium, caesium, magnesium, calcium, strontium, barium, or yttrium. Chlorides or other salts may be used, including mixture of chlorides or other salts.

By selecting an appropriate electrolyte, almost any metal oxide may be capable of reduction using the methods and apparatuses described herein. In particular, oxides of beryllium, boron, magnesium, aluminium, silicon, scandium, titanium, vanadium, chromium, manganese, iron, cobalt, nickel, copper, zinc, germanium, yttrium, zirconium, niobium, molybdenum, hafnium, tantalum, tungsten, and the lanthanides including lanthanum, cerium, praseodymium, neodymium, samarium, and the actinides including actinium, thorium, protactinium, uranium, neptunium and plutonium may be reduced, preferably using a molten salt comprising calcium chloride.

The skilled person would be capable of selecting an appropriate electrolyte in which to reduce a particular metal oxide, and in the majority of cases an electrolyte comprising calcium chloride will be suitable.

SPECIFIC EMBODIMENTS OF THE INVENTION

Specific embodiments of the invention will now be described by way of example, with reference to the Figures, in which.

Figure 1:
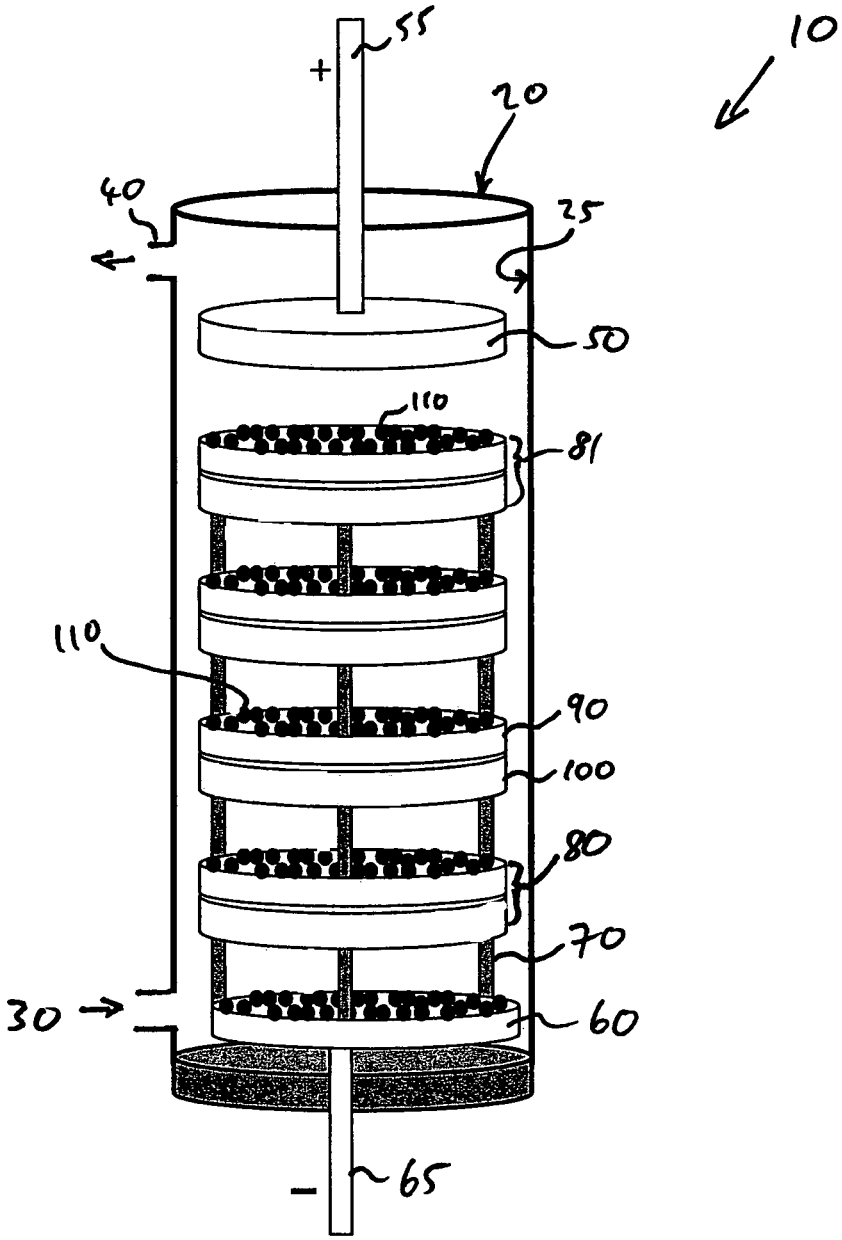
FIG. 1 is a schematic diagram illustrating an apparatus according to a first embodiment of the invention.

FIG. 1 is a schematic diagram of an apparatus according to a first embodiment of the invention. The apparatus 10 comprises a substantially cylindrical housing 20 having a circular base of 150 cm diameter and a height of 300 cm. The housing has walls made of stainless steel defining an internal cavity or space, and an inlet 30 and an outlet 40 for allowing molten salt to flow into and out of the housing. The housing walls may be made of any suitable material. Such materials may include carbon steels, stainless steels and nickel alloys. The molten salt inlet 30 is defined through a lower portion of the housing wall and the molten salt outlet 40 is defined through an upper portion of the housing wall. Thus, in use, molten salt flows into the housing at a low point and flows upwardly through the housing eventually passing out of the housing through the outlet.

The internal walls of the housing are clad with alumina to ensure that the internal surfaces of the housing are electrically insulating.

An anode 50 is disposed within an upper portion of the housing. The anode is a disc of carbon having a diameter of 100 cm and a thickness of 5 cm. The anode is coupled to an electricity supply via an electrical coupling 55 that extends through the wall of the housing and forms a terminal anode.

A cathode 60 is disposed in a lower portion of the housing. The cathode is a circular plate an inert metal alloy, for example tantalum, molybdenum or tungsten having a diameter of 100 cm. The choice of cathode material may be influenced by the type of feedstock being reduced. The reduced product preferably does not react with or substantially adhere to the cathode material under cell operating conditions. The cathode 60 is connected to an electricity supply by an electrical coupling 65 that extends through a lower portion of the housing wall and forms a terminal cathode. The circumference of the cathode is bounded by an upwardly extending rim forming a tray-like upper surface to the cathode.

The upper surface of the cathode 60 supports a number of electrically insulating separating members 70 that act to support a bipolar element 80 directly above the cathode. The separating members are columns of boron nitride, yttrium oxide, or aluminium oxide having a height of 10 cm. It is important that the separating members are electrically insulating and substantially inert in the operating conditions of the apparatus. The separating members must be sufficiently inert to function for an operating cycle of the apparatus. After reduction of a batch of feedstock during an operating cycle of the apparatus, the separating members may be replaced, if required. They must also be able to support the weight of a cell stack comprising a plurality of bipolar elements. The separating members are spaced evenly around the circumference of the cathode and support the bipolar element 80 immediately above the cathode.

Each bipolar element 80 is formed from a composite structure having a cathodic upper portion 90 and an anodic lower portion 100. In each case the anodic portion is a disc of carbon of 100 cm diameter and 3 cm thickness and the cathodic upper portion 90 is a circular metallic plate having diameter of 100 cm and an upwardly extending peripheral rim or flange such that the upper portion of the cathodic portion 90 forms a tray.

The apparatus comprises ten such bipolar elements 80, each bipolar element supported vertically above the last by means of electrically insulating separating members 70. (For clarity only 4 bipolar elements are shown in the schematic illustration of FIG. 1.) The apparatus can comprise as many bipolar elements as are required positioned within the housing and vertically spaced from each other between the anode and the cathode, thereby forming a bipolar stack comprising the terminal anode, the terminal cathode and the bipolar elements. Each bipolar element is electrically insulated from the others. The uppermost bipolar element 81 does not support any electrically insulating separating members and is positioned vertically below the terminal anode 50.

The upper surface of the terminal cathode and the upper surfaces of each of the bipolar elements act as a support for a solid feedstock 110 made up from a plurality of constituent units. The constituent units of the solid feedstock 110 are in the form of titanium dioxide performs manufactured by a known powder extrusion process from a paste formed from a titanium dioxide powder. These extruded performs are freely poured onto the upper surface of each cathodic portion. The upwardly extending rim or flange that bounds the upper surface of each cathodic portion acts to retain the feedstock on the upper surface of each bipolar element.

Figure 2:
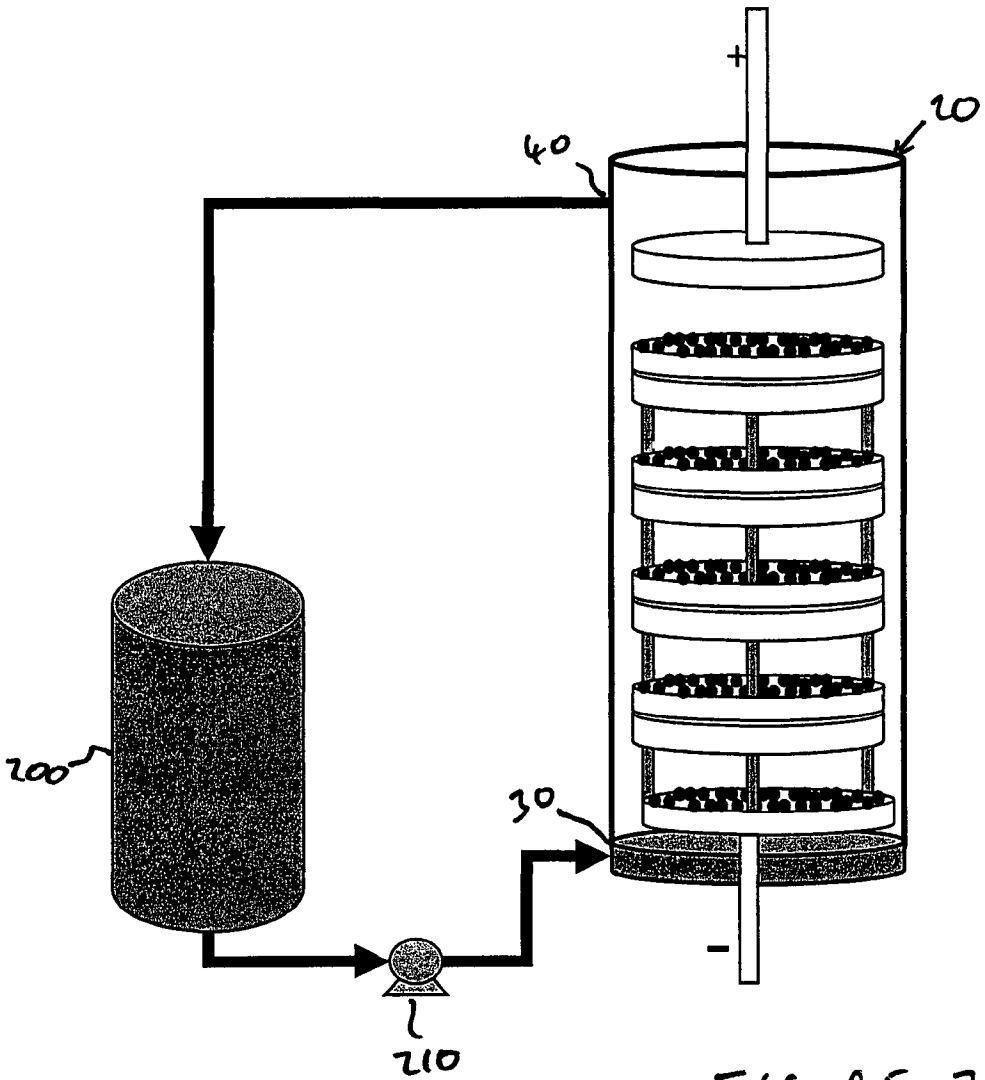
FIG. 2 is a schematic diagram illustrating the apparatus of FIG. 1 in connection with a molten salt flow circuit.

FIG. 2 illustrates the apparatus of FIG. 1 when coupled to a molten salt reservoir 200. The molten salt reservoir is coupled to the housing 20 such that molten salt can be pumped (using pump 210) into the housing through inlet 30 and out of the housing through outlet 40.

The molten salt reservoir 200 contains a heating element to maintain the molten salt at the desired temperature. For the purposes of reducing titanium dioxide a preferred molten salt comprises calcium chloride with some dissolved calcium oxide.

A method of using the apparatus of the first embodiment of the invention will now be described using the reduction of titanium dioxide to titanium metal as an example.

There may be a number of ways of loading an apparatus with feedstock, and the following is exemplary only. The housing is opened, for instance by removing a lid or opening a hatch in the housing that allows access to the internal portion of the housing. A volume of feedstock is poured onto the terminal cathode disposed in the lower portion of the housing, such that the surface of the terminal cathode is covered with feedstock. The feedstock is prevented from rolling from the surface of the cathode by the rim bounding the upper surface of the cathode.

A bipolar element is then supported above the cathode by electrically insulating separating members 70 that rest on the upper surface of the cathode 60. A volume of feedstock is then poured onto the surface of the bipolar element until the upper surface of the bipolar element 80 is covered with feedstock. As described in relation to the cathode 60, the feedstock is maintained on the upper surface of the bipolar element by an upwardly extending rim bounding the upper, cathodic, surface 90 of the bipolar element 80.

This process is repeated again for each bipolar element comprised in the bipolar cell stack. Each new bipolar element is supported in vertical separation from a lower bipolar element by means of electrically insulating separating members, and feedstock is applied to the surface of the bipolar element. When all of the bipolar elements have been arranged (for example there may be ten vertically spaced bipolar elements within a bipolar cell stack), the terminal anode 50 is arranged above the uppermost terminal bipolar element 81, and the housing is sealed, for example by replacing the lid or closing the access hatch.

Figure 3:
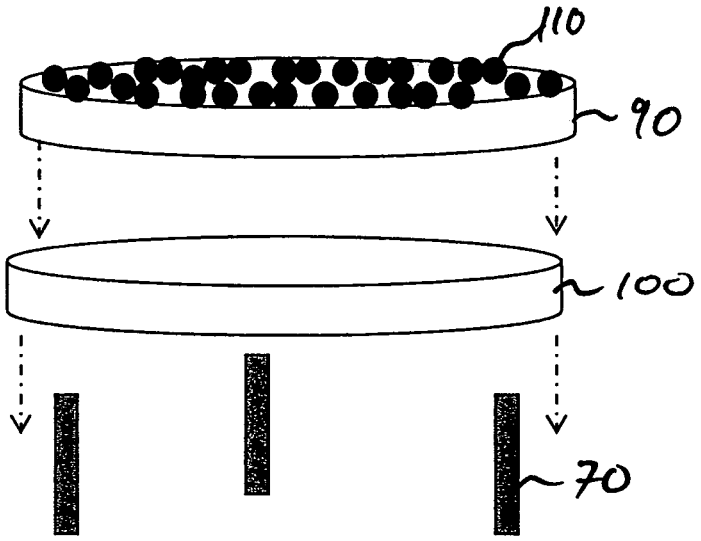
FIG. 3 is a schematic drawing illustrating the components making up a bipolar element and its supports according to the embodiment of FIG. 1.

FIG. 3 illustrates the components of a unit cell, or repeat unit, of the bipolar element portion of the bipolar cell stack, comprising a number of separating members supporting a bipolar element. The unit cell comprises boron nitride or yttrium oxide electrically-insulating separating members 70. These separating members are 10 cm long. The lower, anodic portion of the bipolar element 100 is a 3 cm thick carbon disc or plate having a diameter of 100 cm, and is supported on top of the separating members. Resting on top of the carbon anode portion 100 is the upper or cathodic portion of the bipolar element 90 which is in the form of a titanium tray having a diameter of 100 cm. The surface area of the tray is approximately 0.78 $m^2$ and the titanium dioxide feedstock particles 110 are supported on this surface.

A suitable molten salt for performing the electrolytic reduction of many different feedstock materials may comprise calcium chloride. In the specific example of a reduction of titanium dioxide, a preferred salt is calcium chloride containing between about 0.2 and 1.0 weight % more preferably 0.3 to 0.6% dissolved calcium oxide.

The salt is heated to a molten state in a separate crucible or reservoir 200 that is coupled to the housing by means of a molten salt circuit. The circuit comprises tubing or pipework made of graphite, glassy carbon or a suitable corrosion-resistant metal alloy through which the molten salt can be made to flow, for example by means of a pump 210.

It is undesirable to pump molten salt at the working temperature (for example between 700° C. and 1000° C.) directly into the housing while the housing is at room temperature. Therefore, the housing is warmed first. Hot inert gas is passed through the housing by means of hot gas inlets and outlets (not shown) and the flow of hot gas through the housing heats up the internal portion of the housing and the elements contained within the internal portion of the housing. This process also has the effect of purging the cell of undesirable atmospheric oxygen and nitrogen. When the internal portion of the housing and the elements contained therein have reached a sufficient temperature, for example a temperature at or near to the molten salt temperature, valves in the molten salt flow circuit are opened, and molten salt is allowed to flow into the housing through inlet 30. Because the internal portion of the housing has been warmed there is no substantial freezing of the molten salt as it enters the housing, and the molten salt level rises, covering successive bipolar elements and the feedstock supported thereon. When the molten salt reaches the uppermost portion of the housing, it flows out of the outlet and back to the molten salt reservoir.

After a molten salt flow has been set up through the housing, the reduction may be carried out by the electrolysis, for example by electro-decomposition.

The housing may not be exactly cylindrical. For example, the housing may not have parallel sides, but may instead be tapered, preferably a taper that extends outwards towards the top of the housing. Such a taper allows extra room within the housing for gases that evolve during processing.

The lower portion of each bipolar element may include or comprise slots or recesses on its underside to act as escape channels or recesses to aid the removal of evolved gasses.

Hence the, or each bipolar element may comprise a composite structure having, for example, an upper metallic cathode portion and a lower carbon anode portion. The lower portion itself may comprise an upper reusable portion that contacts the cathode portion and a lower consumable portion that has recesses on its underside to act as gas escape channels.

Gas in the form of carbon dioxide, carbon monoxide or oxygen, will be evolved at the anodic surfaces and it may be advantageous to channel this gas towards the sides of the housing so that the gas may be transported to the uppermost portion of the housing more swiftly. Once at the uppermost portion of the housing, the gas may be vented by means of vents (not shown). Scum may be formed during the electrolytic production of feedstock, and this scum will also be channelled to the uppermost portion of the housing. Preferably, the scum is removed to prevent accumulation of contaminant elements such as carbon.

Although each bipolar element is preferably substantially horizontally disposed within the housing, the elements may be arranged to have a slight incline from the horizontal. The incline may aid in the transport of evolved gas, for example by directing evolved gas towards a gas channel towards, or at, the side of the housing.

In an exemplary method of using the apparatus, a potential is applied between the terminal cathode and the terminal anode, such that the upper surfaces of the terminal cathode and each of the bipolar elements becomes cathodic. The potential at each cathodic surface is sufficient to cause reduction of the feedstock supported by each cathodic surface preferably without causing deposition of calcium from the calcium chloride based molten salt. For example, to form a cathodic potential of about 2.5 volts on the surface of each of the bipolar elements, if there are ten such elements, requires a potential of between approximately 25 and 50 volts to be applied between the terminal cathode and terminal anode.

In general terms the voltage to be applied to a bipolar cell stack for reducing titanium oxide, or other metal compounds, in a $CaCl_2$/CaO melt may be evaluated as follows. The electrolyte solution potential difference between upper and lower edges of the cathodic and anodic surface of a bipolar element should be such as to cause the reduction of the feedstock and the formation of the anodic gaseous product e.g. carbon dioxide or oxygen. This will be termed the Bipolar Potential. This is typically in the region of 2.5 to 2.8 volts.

In addition, a potential is also required to overcome the electrical resistance of the molten electrolyte between the bipolar elements. This is typically of the order of 0.2 to 1.0 volts.

So, to achieve the desired results one needs to apply a potential that is high enough to account for the Bipolar Potential plus the inter-element electrolyte potential. Hence, this typically equates to 2.7 to 3.8 volts per bipolar element plus inter-element spacing.

To form a Bipolar potential of about 2.5-2.8 volts on each of the bipolar elements in a stack, one needs to prorate the potential applied to the terminal electrodes to account for the number of bipolar elements and inter element spacings. For example, if there are ten such elements, one should apply a potential eleven times that required by a single bipolar element. With this being in the region of 2.7 to 3.8 volts per element one needs to apply a voltage in the region of 29.7-41.8 volts across the terminal electrodes.

In an FFC electro-decomposition method for the reduction of an oxide feedstock in a calcium chloride salt, oxygen is removed from the feedstock without deposition of calcium from the molten salt.

The mechanism for FFC reduction in a bipolar cell may be as follows.

Current is passed between the terminal cathode and terminal anode primarily by means of ionic transfer through the melt. For example, $O^{2-}$ ions are removed from the feedstock supported on the terminal cathode by electro-deoxidation and are transported to the anodic portion 100, of the bipolar element immediately above the terminal cathode. The reaction of the oxygen ions with the carbon anode results in the evolution of a mixture of gaseous carbon monoxide, carbon dioxide and oxygen.

Electrons transported through the melt by the $O^{2-}$ ion are transferred to the carbon portion of the bipolar element and into the cathodic titanium portion of the bipolar element where they are available for the electro-decomposition reaction of the titanium dioxide supported on the upper portion of the bipolar element. The electro-decomposition reaction causes the removal of oxygen from the titanium dioxide in the form of $O^{2-}$ ions, and these ions are then transported to the next bipolar element immediately above the first bipolar element. The process is repeated until $O^{2-}$ ions are transported to the terminal anode.

Reduction of the feedstock may be carried out using processes other than the FFC process. For example, electro-decomposition could be carried out using the higher voltage process as described in WO 03076690.

Figure 4:
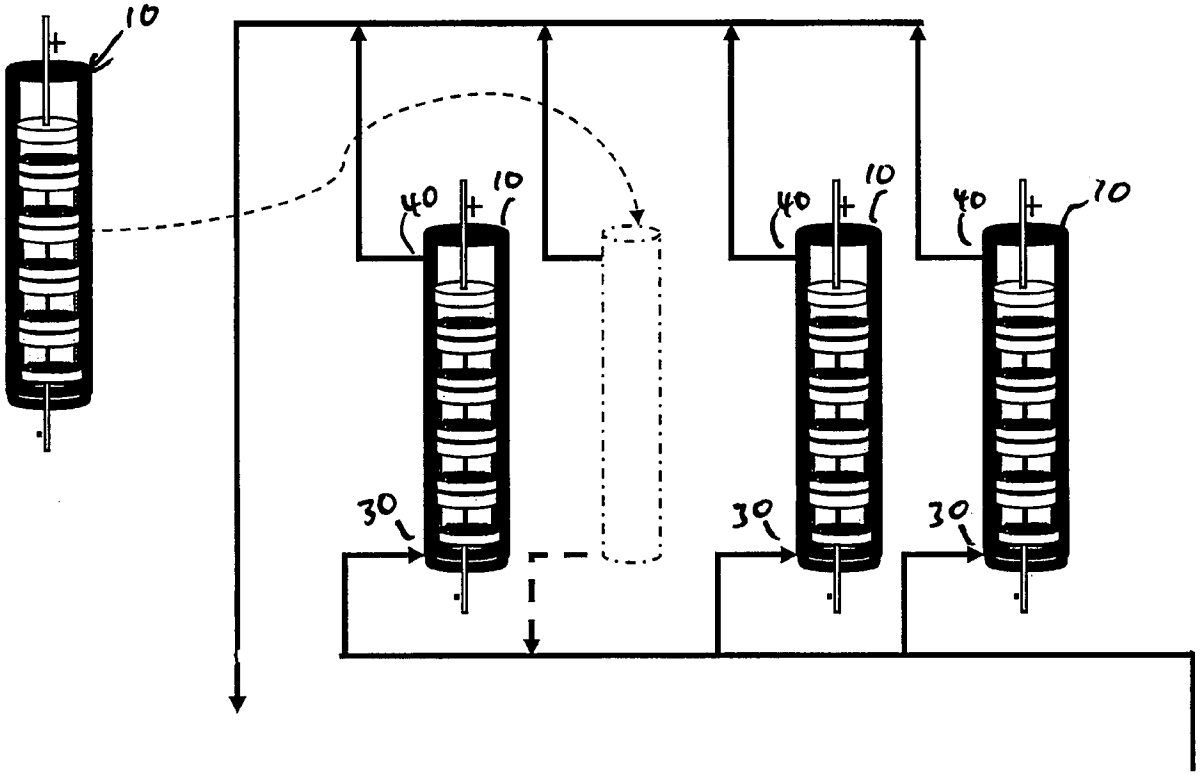
FIG. 4 is a schematic diagram illustrating an apparatus according to a second embodiment of the invention having a plurality of discrete housings, each housing containing a bipolar element stack, each housing being coupled to the same molten salt supply.

FIG. 4 illustrates an apparatus according to a second embodiment of the invention. The apparatus for reduction may be arranged such that there are a plurality of housings 10 (each as described above), arranged such that molten salt from a single source or reservoir may flow through each of the plurality of housings in parallel. Preferably, each housing is connected to the molten salt flow circuit such that it may be independently removed from the circuit while electrolysis is occurring in other cells of the apparatus. Thus, the molten salt flow through the inlet and outlet may be regulated by means of valves in the molten salt flow circuit, and the electrical connection to the terminal anodes and cathodes may be by means of a switchable or removably-couplable electrical connection.

The use of a plurality of housings in an apparatus advantageously increases the amount of feedstock that may be reduced. If each housing is switchable, then feedstock may be loaded into new housings offline, i.e. while electrolytic reduction is being performed in other such housings, and then each new housing may be introduced into the apparatus without the need of shutting the apparatus down. In this way the electrolysis process may be transformed into a semi-continuous process. There are advantages to be had in terms of throughput of feedstock and in reduction of downtime of the apparatus, and there are also electricity energy savings to be made from the fact that the salt can be maintained at temperature during the process of the reduction of multiple cell stacks containing feedstock.

Figure 5:
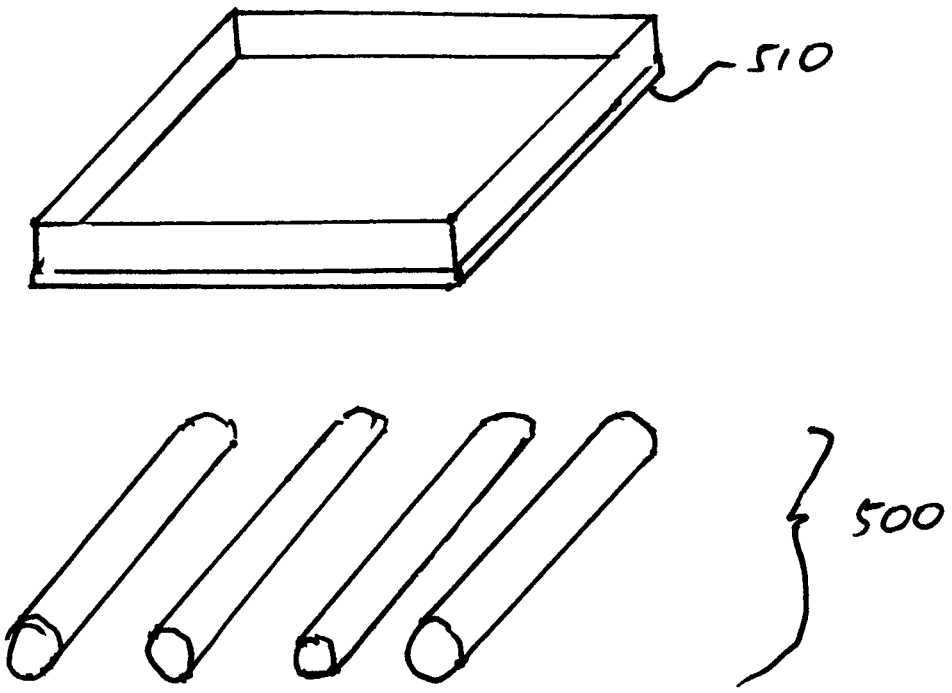
FIG. 5 is a schematic diagram illustrating the components of a bipolar element of a third embodiment of the invention.

FIG. 5 illustrates an alternative embodiment of a bipolar element suitable for use in the various apparatus described above. The bipolar element consists of a lower portion or anodic portion 500 which consists of a plurality of carbon rods supported by the internal wall of a housing in an apparatus embodying the invention. The upper or cathodic portion of the bipolar element consists of a metallic tray 510 that rests on the anodic rods such that there is electrical connection between the rods and the tray.

It can be seen that the lower portion may comprise other materials than carbon, for example, inert oxygen-evolving anode materials. The lower portion may also be in the form of mesh or a grid, and likewise the upper portion may be in the form of a mesh or a grid, so long as it is capable of supporting the solid feedstock.

It is also within the scope of the invention that the bipolar element is not a composite, but in fact a single material. For example, the bipolar element may simply be a carbon plate or a carbon mesh.

We claim:

1. A method of reducing a solid feedstock comprising the steps of, arranging the feedstock on the upper surfaces of bipolar elements in a bipolar cell stack disposed within a housing, circulating molten salt through the housing such that the salt contacts the elements and the feedstock, applying a potential to terminal electrodes of the bipolar cell stack such that the upper surface of the elements become cathodic and the lower surface of the elements become anodic, the applied potential being sufficient to cause reduction of the solid feedstock, and in which one or more bipolar element in the bipolar stack has a composite structure comprising an upper portion defining the upper surface and a separate lower portion electrically-couplable to the upper portion, the method comprising the further step of recovering the reduced product by separating the upper portion from the lower portion.

2. The method according to claim 1, in which the bipolar cell stack comprises between 2 and 50 bipolar elements, the feedstock being arranged on the upper surface of each of the elements.

3. The method according to claim 1, in which the feedstock comprises a metal oxide, a mixture of oxides, a metal oxide compound or a mixture of metal and oxide.

4. The method according to claim 1, in which the molten salt is a metal halide salt or mixture of metal halide salts.

5. The method according to claim 1, in which the solid feedstock is reduced to form a reduced product, and the method comprises the further steps of draining the molten salt from the housing and recovering the reduced product.

6. The method according to claim 1, in which the terminal electrodes comprise a terminal anode and a terminal cathode, and a portion of feedstock is arranged on an upper surface of the terminal cathode or on the upper surface of a bipolar element that is in electrical contact with the terminal cathode.

7. The method according to claim 1, comprising the step of removing the bipolar stack, or at least a portion of the bipolar stack comprising the bipolar elements, from the housing in order to load solid feedstock and/or in order to recover reduced product.

8. The method according to claim 1, comprising the step of moving individual bipolar elements out of the bipolar cell stack.

9. The method according to claim 3, in which the feedstock is in the form of granules or particles, or preforms made by a powder processing method.

10. The method according to claim 9, in which the powder processing method is pressing or slip-casting or extrusion.

11. The method according to claim 4, in which the molten salt comprises calcium chloride.

12. The method according to claim 1, in which the reduction occurs by electro-decomposition.

13. The method according to claim 12, in which the reduction occurs by electro-deoxidation.

14. The method according to claim 5, in which the product of the reduction is not fully reduced to metal.

15. The method according to claim 5, in which the product of the reduction is metallic.

16. The method according to claim 15, in which the metallic product is a metal or an alloy.

17. The method according to claim 8, in which individual bipolar elements are moved out of the bipolar cell stack by sliding them out of the stack.

18. The method according to claim 8, in which moving individual bipolar elements out of the bipolar cell stack facilitates access to the upper surfaces of the elements in order to load solid feedstock and/or in order to recover reduced product.

* * * * *

UNITED STATES PATENT AND TRADEMARK OFFICE

CERTIFICATE OF CORRECTION

PATENT NO. : 8,747,644 B2
APPLICATION NO. : 13/320079
DATED : June 10, 2014
INVENTOR(S) : Peter G. Dudley and Allen Richard Wright It is certified that error appears in the above-identified patent and that said Letters Patent is hereby corrected as shown below:

In the Specification

Column 11,
Line 18, "performs" should read --preforms--

Signed and Sealed this
Twentieth Day of January, 2015

Michelle K. Lee

Michelle K. Lee
*Deputy Director of the United States Patent and Trademark Office*